US008468772B2

(12) United States Patent
Oakey et al.

(10) Patent No.: US 8,468,772 B2
(45) **Date of Patent: *Jun. 25, 2013**

(54) CARPET TILES AND CARPET TILE INSTALLATIONS

(75) Inventors: David D. Oakey, Atlanta, GA (US); Graham A. H. Scott, LaGrange, GA (US); John P. Bradford, LaGrange, GA (US); Keith N. Gray, Marietta, GA (US)

(73) Assignee: Interface, Inc., Atlanta, GA (US)

( * ) Notice: Subject to any disclaimer, the term of this patent is extended or adjusted under 35 U.S.C. 154(b) by 199 days.

This patent is subject to a terminal disclaimer.

(21) Appl. No.: 12/814,654

(22) Filed: Jun. 14, 2010

(65) Prior Publication Data

US 2011/0107720 A1 May 12, 2011

Related U.S. Application Data

(63) Continuation-in-part of application No. 12/270,129, filed on Nov. 13, 2008, now Pat. No. 8,381,473, which is a continuation of application No. 11/018,947, filed on Dec. 21, 2004, now Pat. No. 7,464,510, which is a continuation-in-part of application No. 10/381,025, filed on Dec. 8, 2003, now abandoned, and a continuation-in-part of application No. 10/638,878, filed on Aug. 11, 2003, now abandoned.

(60) Provisional application No. 61/268,433, filed on Jun. 12, 2009, provisional application No. 60/619,340, filed on Oct. 15, 2004.

(51) Int. Cl.

| | |
|---|---|
| ***E04B 1/00*** | (2006.01) |
| ***E04G 21/00*** | (2006.01) |
| ***E04G 23/00*** | (2006.01) |

(52) U.S. Cl.

USPC ..... 52/747.11; 52/311.2; 52/385; 52/391; 52/745.05; 428/86; 428/100; 428/99; 428/101; 428/356; 428/351

(58) Field of Classification Search

USPC ..... 52/506.05, 311.2, 385, 391, 745.05, 52/747.11; 428/86, 100, 99, 101, 356, 354

See application file for complete search history.

(56) References Cited

U.S. PATENT DOCUMENTS

| | | | |
|---|---|---|---|
| 406,866 | A | 7/1889 | Atwater |
| 833,571 | A | 10/1906 | Bailey |

(Continued)

FOREIGN PATENT DOCUMENTS

| | | |
|---|---|---|
| AT | 360217 | 12/1980 |
| AU | 2003265409 A1 | 3/2004 |

(Continued)

OTHER PUBLICATIONS

Extended European Search Report, EP Application No. 10180493.8, Nov. 15, 2010, 5 pages.

(Continued)

*Primary Examiner* — William Gilbert
*Assistant Examiner* — Chi Q Nguyen
(74) *Attorney, Agent, or Firm* — Kilpatrick Townsend & Stockton LLP

(57) ABSTRACT

Certain embodiments utilize carpet tiles of varying sizes and/or shapes that are connected together using connectors to form a carpet tile installation. In some instances, the carpet tiles used in the carpet tile installation have different colors, patterns, shapes, and/or styles. In some embodiments, carpet tiles of a standard size and shape, such as one-half square meter carpet tiles, are partitioned into carpet tile fractions. In certain embodiments, these carpet tile fractions are used in conjunction with larger carpet tiles in a carpet tile installation. In other embodiments, these carpet tile fractions may be connected to other carpet tile fractions to form a combination carpet tile that is then used in a carpet tile installation. Among other things, the use of different sized and/or shaped carpet tiles increases the randomness or diversity and/or improves other aspects of the appearance of the floor coverings formed by the carpet tile installations.

20 Claims, 10 Drawing Sheets

U.S. PATENT DOCUMENTS 1,685,362 A 9/1928 Joseph
1,711,149 A 4/1929 Joseph
2,250,669 A 7/1941 Jamgotchian
2,367,536 A 1/1945 Spitzli
2,522,114 A 5/1949 Reinhard
2,647,850 A 8/1953 Reinhard
2,702,919 A 3/1955 Judge
2,709,826 A 6/1955 Reinhard
2,726,419 A 12/1955 Saks et al.
3,083,393 A 4/1963 Nappi
3,120,083 A 2/1964 Dahlberg et al.
3,241,662 A 3/1966 Robinson et al.
3,271,217 A 9/1966 Mapson
3,494,006 A 2/1970 Brumlik
3,538,536 A 11/1970 Pecorella
3,558,384 A 1/1971 Ronning
3,558,385 A 1/1971 Ronning
3,558,386 A 1/1971 Ronning
3,696,459 A 10/1972 Kucera et al.
3,712,845 A 1/1973 Hartung
3,748,211 A 7/1973 Hoopengardner
3,788,941 A 1/1974 Kupits
3,819,773 A 6/1974 Pears
3,858,269 A 1/1975 Sutton et al.
3,928,690 A 12/1975 Settineri et al.
2,969,564 A 7/1976 Carder
3,969,564 A 7/1976 Carder
4,012,544 A 3/1977 Richards
4,114,346 A 9/1978 Kelly
4,152,473 A 5/1979 Layman
4,196,254 A 4/1980 Puskadi
4,242,389 A 12/1980 Howell
4,322,516 A 3/1982 Wiest et al.
4,340,633 A 7/1982 Robbins, Jr.
4,489,115 A 12/1984 Layman et al.
4,557,774 A 12/1985 Hoopengardner
4,561,232 A 12/1985 Gladden, Jr. et al.
4,562,938 A 1/1986 Loder
4,564,546 A 1/1986 Jones
4,571,363 A 2/1986 Culbertson et al.
4,680,209 A 7/1987 Zybko et al.
4,695,493 A 9/1987 Friedlander et al.
4,702,948 A 10/1987 Sieber-Gadient
4,769,895 A 9/1988 Parkins
4,822,658 A 4/1989 Pacione
4,824,498 A 4/1989 Goodwin et al.
4,920,720 A 5/1990 LaBianca
4,947,602 A 8/1990 Pollasky
4,988,551 A 1/1991 Zegler
5,012,590 A 5/1991 Wagner et al.
5,018,235 A 5/1991 Stamatiou et al.
5,034,258 A 7/1991 Grace
5,096,764 A 3/1992 Terry et al.
5,114,774 A 5/1992 Maxim, Jr.
5,116,439 A 5/1992 Raus
5,120,587 A 6/1992 McDermott, III et al.
5,191,692 A 3/1993 Pacione
5,205,091 A 4/1993 Brown
5,217,522 A 6/1993 Riebel et al.
5,217,552 A 6/1993 Miyajima et al.
5,304,410 A 4/1994 Webster
5,401,547 A 3/1995 Blackwell et al.
5,422,156 A 6/1995 Billarant
5,438,809 A 8/1995 Ehrlich
5,447,004 A 9/1995 Vrnak
5,522,187 A 6/1996 Bogaerts
5,564,251 A 10/1996 Van Bers
5,609,933 A 3/1997 Stepanek
5,634,309 A 6/1997 Polen
5,672,404 A 9/1997 Callahan, Jr. et al.
5,683,780 A 11/1997 Rodger et al.
5,691,027 A 11/1997 Eckhardt et al.
5,706,623 A 1/1998 Brown
5,761,765 A 6/1998 Fuzzell
5,822,828 A 10/1998 Berard et al.
5,834,081 A 11/1998 Fanti
5,863,632 A 1/1999 Bisker
5,888,335 A 3/1999 Kobe et al.
5,931,354 A 8/1999 Braud et al.
5,958,540 A 9/1999 Berard et al.
5,995,884 A 11/1999 Allen
6,068,904 A 5/2000 Stearns
6,083,596 A 7/2000 Pacione
6,093,469 A 7/2000 Callas
6,216,315 B1 4/2001 Fuzzell
6,253,526 B1 7/2001 Murphy et al.
6,260,326 B1 7/2001 Muller-Hartburg
6,306,477 B1 10/2001 Pacione
6,333,073 B1 12/2001 Nelson et al.
6,426,129 B1 7/2002 Kalwara et al.
6,475,594 B2 11/2002 Johnston et al.
6,599,599 B1 7/2003 Buckwater et al.
6,694,682 B2 2/2004 Fanti
6,694,689 B1 * 2/2004 Scott et al. ..... 52/392
6,701,685 B2 3/2004 Rippey
6,756,100 B2 6/2004 Pearson et al.
6,756,102 B1 6/2004 Galo
6,803,090 B2 10/2004 Castiglione et al.
6,841,216 B2 * 1/2005 Daniel et al. ..... 428/48
6,849,317 B1 * 2/2005 Oakey et al. ..... 428/88
6,850,024 B2 2/2005 Peless et al.
6,861,118 B2 3/2005 Kobayashi et al.
6,888,459 B2 5/2005 Stilp
6,908,656 B2 6/2005 Daniel
6,977,579 B2 12/2005 Gilfix
6,984,952 B2 1/2006 Peless et al.
7,039,522 B2 5/2006 Landau
7,083,841 B2 * 8/2006 Oakey et al. ..... 428/88
7,148,803 B2 12/2006 Bandy
7,225,980 B2 6/2007 Ku
7,242,303 B2 7/2007 Patel
7,245,215 B2 7/2007 Gollu
7,297,385 B2 * 11/2007 Daniel et al. ..... 428/48
7,339,523 B2 3/2008 Bye
7,350,443 B2 * 4/2008 Oakey et al. ..... 83/13
7,464,510 B2 12/2008 Scott et al.
7,601,413 B2 * 10/2009 Daniel et al. ..... 428/88
7,672,780 B2 3/2010 Kim
7,721,502 B2 5/2010 Scott et al.
7,757,457 B2 7/2010 Gray et al.
8,220,221 B2 * 7/2012 Gray et al. ..... 52/747.11
8,381,473 B2 2/2013 Scott et al.
2002/0140393 A1 10/2002 Peless
2003/0003263 A1 1/2003 Smith
2003/0071051 A1 4/2003 Martinsen
2003/0180091 A1 9/2003 Stridsman
2004/0095244 A1 5/2004 Conwell et al.
2004/0185682 A1 9/2004 Foulke
2004/0258870 A1 12/2004 Oakey et al.
2005/0007057 A1 1/2005 Peless
2005/0059308 A1 3/2005 Parsons
2005/0089678 A1 4/2005 Mead
2005/0099291 A1 5/2005 Landau
2005/0099306 A1 5/2005 Gilfix
2005/0261571 A1 11/2005 Willis
2006/0048797 A1 3/2006 Jung
2006/0164236 A1 7/2006 Siegl
2006/0261951 A1 11/2006 Koerner
2006/0293794 A1 12/2006 Harwig
2007/0061075 A1 3/2007 Kim
2007/0069021 A1 3/2007 Elrod
2007/0126634 A1 6/2007 Bye
2008/0213529 A1 9/2008 Gray et al.
2009/0045918 A1 2/2009 Droesler et al.
2009/0094919 A1 4/2009 Scott et al.
2010/0024329 A1 2/2010 Gray et al.
2010/0176189 A1 7/2010 Gray et al.
2010/0251641 A1 10/2010 Gallagher
2011/0061328 A1 3/2011 Sandy et al.
2011/0107720 A1 5/2011 Oakey et al.
2013/0014460 A1 1/2013 Scott et al.

FOREIGN PATENT DOCUMENTS

AU 2005295322 A1 4/2006
AU 2008230828 A1 10/2008
AU 2011200866 A1 3/2011
BR PI 0313495-4 A 7/2005

| | | | |
|---|---|---|---|
| BR | PI 0518165-8 | A | 11/2008 |
| CA | 1287966 | | 8/1991 |
| CA | 2421763 | A1 | 3/2002 |
| CA | 2495101 | A1 | 2/2004 |
| CA | 2583532 | A1 | 4/2006 |
| CA | 2679004 | A1 | 10/2008 |
| CA | 2583532 | C | 7/2012 |
| CN | 2116040 | | 9/1992 |
| CN | 2116040 | U | 9/1992 |
| CN | 101084350 | A | 12/2007 |
| CN | ZL200580042610.7 | | 9/2009 |
| CN | 101614066 | A | 12/2009 |
| CN | 101646737 | | 2/2010 |
| CN | 200910164633.5 | B | 1/2013 |
| DE | 1913002 | A1 | 3/1970 |
| DE | 2027415 | A1 | 12/1971 |
| DE | 2304392 | A1 | 1/1973 |
| DE | 2304392 | | 8/1973 |
| DE | 2649644 | | 5/1978 |
| DE | 2649644 | A1 | 5/1978 |
| DE | 10001551 | | 7/2001 |
| DE | 10001551 | A1 | 7/2001 |
| DE | 20111113 | | 10/2001 |
| DE | 20111113 | U1 | 10/2001 |
| DE | 10 2004 007 595 | A1 | 9/2005 |
| EP | 0017986 | | 10/1980 |
| EP | 0017986 | A1 | 10/1980 |
| EP | 0044533 | | 1/1982 |
| EP | 0044533 | A1 | 1/1982 |
| EP | 0237657 | A1 | 9/1987 |
| EP | 0237657 | A1 | 9/1987 |
| EP | 0239041 | A2 | 9/1987 |
| EP | 0942111 | A | 9/1999 |
| EP | 0942111 | A1 | 9/1999 |
| EP | 1313079 | | 5/2003 |
| EP | 1313079 | A2 | 5/2003 |
| EP | 2129735 | | 12/2006 |
| EP | 2129735 | | 12/2009 |
| EP | 2 258 908 | A2 | 12/2010 |
| EP | 2258908 | A3 | 12/2010 |
| EP | 2258909 | A2 | 12/2010 |
| EP | 2258909 | A3 | 12/2010 |
| EP | 2374855 | A2 | 10/2011 |
| EP | 2374855 | A3 | 10/2011 |
| EP | 2374856 | A2 | 10/2011 |
| EP | 2374857 | A2 | 10/2011 |
| EP | 2374856 | A3 | 11/2011 |
| EP | 2374857 | A3 | 11/2011 |
| EP | 2417311 | | 2/2012 |
| EP | 2554616 | A2 | 2/2013 |
| FR | 1239859 | | 7/1960 |
| FR | 2278876 | A | 2/1976 |
| FR | 2582210 | | 11/1996 |
| FR | 2903707 | A1 | 1/2008 |
| GB | 1350767 | | 4/1974 |
| GB | 2113993 | | 8/1983 |
| GB | 2182961 | | 5/1987 |
| GB | 2182961 | A | 5/1987 |
| GB | 2 299 019 | A | 9/1996 |
| GB | 2 342 040 | A | 4/2000 |
| GB | 2389075 | A | 12/2003 |
| HK | 1114890 | B | 4/2010 |
| JP | 55086714 | A | 6/1980 |
| JP | 55086714 | A | 6/1980 |
| JP | 62010181 | A | 1/1987 |
| JP | 02-038152 | | 8/1990 |
| JP | 5163825 | | 6/1993 |
| JP | H5-163825 | | 6/1993 |
| JP | 7259305 | A | 10/1995 |
| JP | 09209545 | A | 8/1997 |
| JP | 09209546 | | 8/1997 |
| JP | 09209546 | A | 8/1997 |
| JP | 9-279106 | | 10/1997 |
| JP | 09279106 | A | 10/1997 |
| JP | 11270115 | | 10/1999 |
| JP | 11270115 | A | 10/1999 |
| JP | 2000328759 | | 11/2000 |
| JP | 2001115631 | A | 4/2001 |
| JP | 2004-003191 | A | 1/2004 |
| JP | 2005-538760 | A | 12/2005 |
| JP | 2008-517190 | A | 5/2008 |
| JP | 2010-523841 | A | 7/2010 |
| JP | 2010523841 | | 7/2010 |
| JP | 2011-94478 | | 5/2011 |
| JP | 2011-94478 | A | 5/2011 |
| JP | 4945452 | | 3/2012 |
| KR | 10-2007-0068368 | A | 6/2007 |
| KR | 10-2010-0014594 | A | 2/2010 |
| MX | PA 03002223 | | 6/2003 |
| MX | 285845 | | 4/2011 |
| NL | 1028881 | | 4/2005 |
| WO | 98/10688 | A1 | 3/1998 |
| WO | 9820330 | A1 | 5/1998 |
| WO | 9835276 | A1 | 8/1998 |
| WO | WO-9835276 | | 8/1998 |
| WO | 00/47837 | A1 | 8/2000 |
| WO | 0075417 | A1 | 12/2000 |
| WO | 0225004 | A2 | 3/2002 |
| WO | 02025004 | A3 | 7/2002 |
| WO | 03060256 | A1 | 7/2003 |
| WO | 2004016848 | A2 | 2/2004 |
| WO | WO-2004016848 | | 2/2004 |
| WO | 2004016848 | A3 | 5/2004 |
| WO | 2005071597 | A1 | 8/2005 |
| WO | WO-2005071597 | | 8/2005 |
| WO | 2005092632 | A1 | 10/2005 |
| WO | WO-2005092632 | | 10/2005 |
| WO | 2005112775 | A1 | 12/2005 |
| WO | 2005118273 | A1 | 12/2005 |
| WO | WO-2005112775 | | 12/2005 |
| WO | 2006/044928 | A2 | 4/2006 |
| WO | 2006045819 | A2 | 5/2006 |
| WO | WO-2006045819 | | 5/2006 |
| WO | 2006/066299 | A1 | 6/2006 |
| WO | 2006065430 | A1 | 6/2006 |
| WO | 2006065839 | A2 | 6/2006 |
| WO | WO-2006065430 | | 6/2006 |
| WO | WO-2006065839 | | 6/2006 |
| WO | 2006/044928 | A3 | 8/2006 |
| WO | 2006096431 | A2 | 9/2006 |
| WO | WO-2006096431 | | 9/2006 |
| WO | 2006116528 | A2 | 11/2006 |
| WO | WO-2006116528 | | 11/2006 |
| WO | 2006128783 | A1 | 12/2006 |
| WO | WO-2006128783 | | 12/2006 |
| WO | 2007002708 | A1 | 1/2007 |
| WO | WO-2007002708 | | 1/2007 |
| WO | 2007018523 | A3 | 2/2007 |
| WO | WO-2007018523 | | 2/2007 |
| WO | 2007033980 | A3 | 3/2007 |
| WO | WO-2007033980 | | 3/2007 |
| WO | 2007072389 | A1 | 6/2007 |
| WO | WO-2007072389 | | 6/2007 |
| WO | 2007081823 | A2 | 7/2007 |
| WO | WO-2007081823 | | 7/2007 |
| WO | 2007098925 | A1 | 9/2007 |
| WO | WO-2008119003 | | 10/2008 |
| WO | 2008119003 | A3 | 12/2008 |
| WO | WO-2010118084 | | 10/2010 |
| WO | WO-2010144897 | | 12/2010 |
| WO | 2010118084 | A3 | 3/2011 |

OTHER PUBLICATIONS

Amendment and Response to Apr. 19, 2007 Office Action, U.S. Appl. No. 11/018,947, Jul. 19, 2007, 11 pages.

Communication Pursuant to Article 94(3) EPC, EP Application No. 10180426.8, Sep. 7, 2011, 4 pages.

Communication Pursuant to Article 94(3) EPC, EP Application No. 101804938, Nov. 10, 2011, 5 pages.

Communication Pursuant to Article 96(2) EPC, EP Application No. 01977126.0, Oct. 30, 2006, 3 pages.

Communication Pursuant to Rule 69 EPC and Invitation Pursuant to Rule 70a(1) EPC, EP Application No. 11172031.4, Nov. 14, 2011, 2 pages.

Communication Pursuant to Rule 69 EPC and Invitation Pursuant to Rule 70a(1) EPC, EP Application No. 10180426.8, Dec. 20, 2010, 2 pages.

Communication Pursuant to Rule 69 EPC and Invitation Pursuant to Rule 70a(1)EPC, EP Application No. 11172028.0, Nov. 7, 2011, 2 pages.
Communication Pursuant to Rule 69 EPC and Rule 70a(1)EPC, EP Application No. 11172023.1, Oct. 31, 2011, 2 pages.
Communication Pursuant to Rules 109 and 110 EPC, EP Application No. 03788382.4, Apr. 25, 2005, 2 pages.
Communication Pursuant to Rules 109 and 110 EPC, EP Application No. 01977126.0, May 9, 2003, 2 pages.
Communication Pursuant to Rules 161 and 162 EPC, EP Application No. 08744428.7, Nov. 3, 2009, 2 pages.
EP Extended European Search Report, EP Application No. 11172031.4, Oct. 10, 2011, 3 pages.
EP Rule 161(1) and 162 EPC Communication, EP Application No. 107147282, Dec. 1, 2011, 2 pages.
Examination, Prior Art and Voluntary Amendment, Canadian Patent Application No. 2,583,532, Jan. 17, 2008, 14 pages.
Extended Search Report and Written Opinion, EP Application No. 10180426.8, Nov. 17, 2010, 6 pages.
Extended Search Report and Written Opinion, EP Application No. 11172023.1, Sep. 27, 2011, 6 pages.
Extended Search Report and Written Opinion, EP Application No. 11172028.0, Sep. 29, 2011, 6 pages.
Final Office Action, U.S. Appl. No. 12/573,960, Nov. 17, 2011, 9 pages.
First Office Action, Chinese Patent Application No. 2009101646335, May 10, 2010, 6 pages.
Fourth Office Action, Chinese Patent Application No. 2009101646335, Oct. 19, 2011, 3 pages [no translation available].
International Preliminary Examination Report, PCT/US2003/025120, Dec. 28, 2004, 7 pages.
International Preliminary Report on Patentability, PCT/US2005/037507, Apr. 17, 2007, 13 pages.
International Preliminary Report on Patentability, PCT/US2005/018587, Nov. 29, 2006, 4 pages.
International Preliminary Report with Written Opinion, PCT/US2010/038471, Dec. 12, 2011, 7 pages.
International Search Report, PCT/US2003/025120, Apr. 5, 2004, 3 pages.
International Search Report, PCT/US2005/18587, Sep. 9, 2005, 3 pages.
International Search Report, PCT/US2001/29313, Apr. 8, 2002, 4 pages [best available copy].
Invitation to Pay Additional Fees, PCT/US2005/037507, Mar. 2, 2006, 9 pages.
Notice of Acceptance, Australian Patent Application No. 2005295322, Nov. 23, 2010, 3 pages.
Notice of Allowance, Canadian Patent Application No. 2,583,532, Nov. 18, 2011, 1 page.
Notice of Allowance, Mexican Patent Application No. MX/a/2007/004405, Feb. 24, 2011, 1 page [no translation available].
Notice of Allowance, U.S. Appl. No. 12/270,129, Oct. 17, 2011, 5 pages.
Notice of Allowance with Examiner's Amendment, U.S. Appl. No. 12/056,916, Apr. 26, 2010, 6 pages.
Notice of Allowance with Examiner's Amendment, U.S. Appl. No. 11/251,733, Jan. 11, 2010, 6 pages.
Office Action, Japanese Patent Application No. 2007537027, Sep. 14, 2010, 10 pages.
Office Action, Mexican Patent Application No. Mx/a/2007/004405, Oct. 6, 2010, 3 pages [no translation available].
Communication pursuant to Article 94(3) EPC, EP Application No. 05812737.4, Nov. 19, 2009, 3 Pages.
Communication pursuant to Article 94(3) EPC, EP Application No. 05812737.4, Nov. 28, 2008, 3 Pages.
Communication pursuant to Article 94(3) EPC, EP Application 05812737.4, Nov. 15, 2010, 5 pages.
Final Office Action, U.S. Appl. No. 12/702,509, Aug. 17, 2010, 6 pages.
Office Action, U.S. Appl. No. 11/018,947, Nov. 28, 2007, 12 pages.
Office Action, U.S. Appl. No. 11/018,947, Apr. 19, 2007, 6 pages.
Notice of Allowance, U.S. Appl. No. 12/270,129, Sep. 29, 2010, 4 pages.
Office Action, U.S. Appl. No. 12/270,129, Sep. 2, 2009, 5 pages.
Office Action, U.S. Appl. No. 12/573,960, Oct. 4, 2010, 7 pages.
Office Action, U.S. Appl. No. 12/702,509, Apr. 26, 2010, 6 pages.
Final Office Action, U.S. Appl. No. 12/702,509, Aug. 17, 2010, 8 pages.
El-Zabadani, Hicham et al., A Mobile Sensor Platform Approach to Sensing and Mapping Pervasive Spaces and Their Contents, University of Florida, Mobile & Pervasive Computing Laboratory, CISE Dept., Date Unknown, 17 pages.
International Search Report and Written Opinion, PCT/US2005/037507, May 31, 2006, 19 pages.
International Preliminary Report on Patentabilty, PCT/US2008/058361, Nov. 8, 2009, 11 pages.
International Search Report and Written Opinion, PCT/US2008/058361, Nov. 7, 2008, 18 pages.
Office Action, U.S. Appl. No. 10/381,025, Jan. 24, 2007, 8 pages.
Office Action, U.S. Appl. No. 11/251,733, Aug. 31, 2009, 6 pages.
Office Action, U.S. Reexamination Control No. 95/001,726, Nov. 10, 2011, 32 pages.
Office Action, U.S. Reexamination Control No. 95/001,725, Nov. 10, 2011, 46 pages.
Patent Owners Response to Office Action in Inter Partes Reexamination with Exhibits A—J3, U.S. Reexamination Control No. 95/001,726, Mar. 9, 2012, 270 pages.
Patent Owner's Response to Office Action in Inter Partes Reexamination with Exhibits A—J3, U.S. Reexamination Control No. 95/001,725, Mar. 9, 2012, 280 pages.
Petition Under 37 C.F.R. § 1.91(a)(3) to Admit Non-Conforming Exhibits in an Inter Partes Reexamination, U.S. Reexamination Control No. 95/001,725, Mar. 9, 2012, 6 pages.
Petition Under 37 C.F.R. § 1.91(a)(3) to Admit Non-Conforming Exhibits in an Inter Partes Reexamination, U.S. Reexamination Control No. 95/001,726, Mar. 9, 2012, 6 pages.
Communication Proceeding Pursuant to Article 96(1) and Rule 51 (1) EPC, EP Application No. 019771260, Jun. 8, 2006, 3 pages.
Response to Aug. 15, 2008 First Office Action, Chinese Patent Application No. 2005800426107, Feb. 26, 2009, 27 pages [translation of claims only].
Response to Apr. 16, 2010 Office Action, U.S. Appl. No. 12/702,509, Jun. 9, 2010, 4 pages.
Response to Apr. 25, 2005 Rule 109 Communication, EP Application No. 03788382.4, May 24, 2005, 9 pages.
Response to Apr. 27, 2006 Office Action, U.S. Appl. No. 10/638,878, Oct. 24, 2006, 7 pages.
Response to Apr. 5, 2011 Office Action, Canadian Patent Application No. 2,583,532, Sep. 29, 2011, 8 pages.
Response to Apr. 8, 2010 Office Action, Canadian Patent Application No. 2,583,532, Oct. 7, 2010, 14 pages.
Response to Aug. 31, 2009 Office Action, U.S. Appl. No. 11/251,733, Oct. 22, 2009, 9 pages.
Response to Aug. 9, 2011 Office Action, Japanese Patent Application No. 2007-537027, Dec. 9, 2011, 9 pages.
Response to Feb. 3, 2010 Examiner's First Report, Australian Patent Application No. 20050295322, Nov. 9, 2010, 17 pages.
Response to Aug. 17, 2010 Final Office Action, U.S. Appl. No. 12/702,509, Dec. 17, 2010, 5 pages.
Response to Mar. 7, 2011 Office Action, U.S. Appl. No. 12/573,960, Aug. 11, 2011, 11 pages.
Response to May 10, 2010 First Office Action, Chinese Patent Application Serial No. 2009101646335, Jul. 20, 2010, 9 pages [translation of claims only].
Response to May 13, 2009 Office Action, Canadian Patent Application No. 2,583,532, Nov. 13, 2009, 18 pages.
Response to May 25, 2011 Third Office Action, Chinese Patent Application Serial No. 2009101646335, Aug. 9, 2011, 12 pages [translation of claims only].
Response to May 9, 2003 Communication Pursuant to Rules 109 and 110 EPC, EP Application No. 019771260, Jun. 6, 2003, 5 pages.
Response to Nov. 15, 2010 Communication Pursuant to Article 94(3) EPC, EP Application No. 05812737.4, May 13, 2011, 12 pages.
Response to Nov. 15, 2010 Extended European Search Report Pursuant to Rule 62 EPC, EP Application No. 10180493.8, Jun. 15, 2011, 55 pages.

Response to Nov. 17, 2010 Communication Pursuant to Rule 62 EPC, EP Application No. 101804268, Jun. 15, 2011, 54 pages.
Response to Nov. 28, 2007 Office Action, U.S. Appl. No. 11/018,947, Mar. 28, 2008, 15 pages.
Response to Oct. 4, 2010 Office Action, U.S. Appl. No. 12/573,960, Nov. 15, 2010, 9 pages.
Response to Oct. 6, 2010 Office Action, Mexican Patent Application No. MX/a/2007/004405, Dec. 9, 2010, 9 pages.
Response to Sep. 14, 2010 Office Action, Japanese Patent Application No. 2007537027, Jan. 14, 2011, 8 pages [no translation available].
Response to Sep. 2, 2009 Office Action, U.S. Appl. No. 12/270,129, Oct. 26, 2009, 9 pages.
Response to Sep. 29, 2009 Communication Pursuant to Rule 161EPC, EP Application No. 08744428.7, Dec. 11, 2009, 6 pages.
Response to Sep. 9, 2010 Second Office Action, Chinese Patent Application No. 2009101646335, Oct. 14, 2010, 9 pages [translation of claims only].
Second Office Action, Chinese Patent Application No. 2009101646335, Sep. 9, 2010, 8 pages.
Summons to Attend Oral Proceedings Pursuant to Rule 115(1) EPC, EP Application No. 058127374, Nov. 15, 2011, 4 pages.
Supplemental Notice of Allowability, U.S. Appl. No. 12/270,129, Nov. 17, 2011, 2 pages.
Supplemental Petition Under 37 C.F.R. § 1.183 to Exceed the Page Limit for Patent Owners Response in an Inter Partes Reexamination, U.S. Reexamination Control No. 95/001,725, Mar. 9, 2012, 4 pages.
Supplemental Petition Under 37 C.F.R. § 1.183 to Exceed the Page Limit for Patent Owners Response in an Inter Partes Reexamination, U.S. Reexamination Control No. 95/001,726, Mar. 9, 2012, 4 pages.
Supplementary European Search Report, EP Application No. 01977126.0, May 18, 2006, 3 pages.
Third Office Action, Chinese Patent Application No. 2009101646335, May 25, 2011, 5 pages [no translation available].
Voluntary Amendment, Brazilian Patent Application No. PI0313495-4, Feb. 23, 2006, 16 pages [no translation available].
Voluntary Amendment, Australian Patent Application No. 2003265409, Apr. 11, 2005, 20 pages.
Voluntary Amendment, Korean Patent Application No. 1020077008403, Oct. 15, 2010, 44 pages [translation of claims only].
Voluntary Amendment, Japanese Patent Application No. 2004-529303, Aug. 3, 2005, 5 pages [no translation available].
Voluntary Amendment, Canadian Patent Application No. 2,495,101, Feb. 9, 2005, 6 pages.
Voluntary Amendment, Chinese Patent Application No. 2005800426107, Oct. 12, 2007, 9 pages [no translation available].
Voluntary Amendment, Brazilian Patent Application No. P10518165-8, Oct. 17, 2008, 43 pages [no translation available].
WOLFF TFV Carpet Tile Connector, WOLFF GmbH, WOLFF TFV Carpet Tile Connector, WOLFF GmbH, 1987, 2 pages.
Written Opinion, PCT/US2005/018587, Sep. 9, 2005, 3 pages.
Written Opinion, PCT/US2003/025120, Oct. 8, 2004, 6 pages.
Response to Nov. 28, 2008 94(3) EPC Communication, EP Application No. 05812737.4, May 29, 2009, 75 pages.
Response to Nov. 19, 2010 Communication Pursuant to Article 96(2) EPC, EP Application No. 05812737.4, May 20, 2010, 64 pages.
Notice of Allowance with Examiner's Amendment, U.S. Appl. No. 11/018,947, Aug. 13, 2008, 6 pages.
International Preliminary Report on Patentability, PCT/US2010/030170, Oct. 20, 2011, 11 pages.
International Search Report and Written Opinion, PCT/US2010/030170, Jan. 5, 2011, 17 pages.
Response to Oct. 19, 2011 Fourth Office Action, Chinese Patent Application Serial No. 2009101646335, Mar. 5, 2012, 16 pp. [translation of claims only].
Final Office Action, U.S. Appl. No. 12/573,960, Mar. 15, 2012, 10 pages.
Response to Sep. 7, 2011 Communication Pursuant to Article 94(3) EPC, EP Application No. 10180426.8, Mar. 7, 2012, 21 pages.
Communication Pursuant to Rules 109 and 110 EPC, EP Application No. 05812737.4, May 25, 2007, 2 pages.
Notice of Publication of the Registration and Grant of a Standard Patent, Hong Kong Application No. 08104813.9, Apr. 1, 2010, 1 page.
Notice of Allowance with Examiner's Amendment, U.S. Appl. No. 12,702,509, Mar. 19, 2012, 8 pages.
Decision to Grant Patent, Japanese Patent Application No. 2007537027, Feb. 7, 2012, 6 pages.
Amendment to Response to Sep. 7, 2011 Communication Pursuant to Article 94(3) EPC, EP Application No. 10180426.8, Mar. 19, 2012, 57 pages.
Comments of Requester, Tandus Flooring, Inc., U.S. Reexamination Control No. 95/001,726, Apr. 6, 2012, 37 pages.
Comments of Requester, Tandus Flooring, Inc., U.S. Reexamination Control No. 95/001,725, Apr. 6, 2012, 37 pages.
Communication Regarding Summons to Attend Oral Proceedings, EP Application No. 05812737.4, Mar. 26, 2012, 2 Pages.
Response to Communication Pursuant to Rule 62 EPC and Request for Examination, EP Application No. 11172028.0, Mar. 29, 2012, 102 pages.
Response to Communication Pursuant to Rule 62 EPC and Request for Examination, EP Application No. 11172031.4, Mar. 29, 2012, 152 pages.
Fifth Office Action, Chinese Patent Application No. 2009101646335, Mar. 27, 2012, 6 pages [partial translation].
Amendment, U.S. Appl. No. 12/270,129, Apr. 17, 2012, 13 pages.
Notice of Grant of Patent Right for Invention, Chinese Patent Application No. 2005800426107, May 8, 2009, 4 pages.
Notice of Allowance, U.S. Appl. No. 12/270,129, Mar. 21, 2012, 5 pages.
Second Preliminary Amendment, U.S. Appl. No. 12/270,129, May 14, 2012, 12 pages.
First Office Action, Chinese Patent Application No. 200880010206.5, Mar. 27, 2012, 23 pages.
Response to Mar. 27, 2012 Fifth Office Action, Chinese Patent Application No. 2009101646335, Jun. 11, 2012, 8 pages [translation of claims only].
Response to Final Office Action Accompanying Request for Continued Examination, U.S. Appl. No. 12/573,960, Jun. 15, 2012, 9 pages.
Response to Dec. 1, 2011 Rule 161(1) EPC and 162 EPC Communication, European Patent Application No. 10714728.2, Jun. 11, 2012, 17 pages.
Notice of Allowance with Examiner's Amendment, U.S. Appl. No. 12/270,129, Jun. 29, 2012, 7 pages.
Declaration of David Oakey with Exhibits 1-22, Apr. 2012, 55 pages.
Communication Pursuant to Article 94(3) EPC, European Patent Application No. 11172028.0, Jun. 14, 2012, 4 pages.
Communication Pursuant to Article 94(3) EPC, European Patent Application No. 11172031.4, Jun. 25, 2012, 4 pages.
European Application No. 08744428.7, Office Action mailed on Jan. 13, 2011, 5 Pages.
U.S. Appl. No. 12/573,960, Office Action mailed on Mar. 7, 2011, 14 Pages.
Canadian Application No. 2,583,532, Office Action mailed on Apr. 8, 2010, 3 Pages.
Canadian Application No. 2,583,532, Office Action mailed on May 13, 2009, 3 Pages.
Canadian Application No. 2,583,532, Office Action mailed on Apr. 5, 2011, 4 Pages.
Australian Application No. 2005295322, Office Action mailed on Feb. 3, 2010, 2 Pages.
Chinese Application No. 200580042610.7, Office Action mailed on Aug. 15, 2008, 18 Pages.
Chinese Application No. 200910164633.5, Office Action mailed on May 24, 2010, 2 Pages.
Chinese Application No. 200910164633.5, Office Action mailed on Oct. 8, 2010, 4 Pages.
Chinese Application No. 200910164633.5, Office Action mailed on May 25, 2011, 5 Pages of OA and 4 Pages of English Translation.
International Application No. PCT/US2005/037507, International Preliminary Report on Patentability mailed on Apr. 26, 2007, 2 Pages.
International Application No. PCT/US2005/037507, Written Opinion mailed on May 30, 2006, 12 Pages.

International Application No. PCT/US2010/030170, International Search Report and Written Opinion mailed on Jan. 5, 2011, 17 Pages.
"Office Action Mailed Aug. 9, 2011", Japanese patent Application No. 2007-537027, English Translation.
"Request for Inter Partes Reexamination", Control No. 95/001,726 (Patent No. 7,721,502).
"Request for Inter Partes Reexamination", Control No, 95/001,725 (Patent No. 7,464,510).
Breaking New Ground in Flooring, TacFast systems international website (www.tacfastsystems.com), downloaded on Mar. 3, 2004.
Merchandising. Merriam-Webster Online Dictionary. Retrieved Apr. 10, 2006, http://webster.com/dictionary/merchandising.
Carpet Bargains, Retrieved Apr. 10, 2006 http://web.archive.org/web/19990827025011/carpetbargains.com/index.htm Apr. 27, 2006.
El-Zabadani, Hicham et al., "A Mobile Sensor Platform Approach to Sensing and Mapping Pervasive Spaces and Their Contents", Mobile & Pervasive Computing.
WOLFF TFV Carpet Tile Connector, WOLFF GmbH, 1987.
European Application No. 05812737.4, Office Action mailed Nov. 28, 2008.
European Application No. 05812737.4, Response to Office Action filed May 29, 2009.
European Application No. 05812737.4, Office Action mailed Nov. 19, 2009.
European Application No. 05812737.4, Response to Office Action filed May 20, 2010.
European Application No. 05812737.4, Office Action mailed Nov. 15, 2010.
European Application No. 10180426.8, Extended European Search Report mailed Nov. 17, 2010.
JP 09 209546 A (Inax Corp.) Aug. 12, 1997, Patent Abstracts of Japan, vol. 1997, No. 12 Dec. 25, 1997.
JP 55 086714 A (Dantoo KK) Jun. 30, 1980, Patent Abstracts of Japan, vol. 004, No. 128 (M-031) Sep. 9, 1980.
Japanese Patent Application No. 2007-537027, Office Action dated Sep. 14, 2010.
Mexican Patent Application No. MX/A/2007/004405, Office Action received Oct. 27, 2010.
Chinese Patent Application No. CN200580042610.7, Decision on Granting of Patent Right and Allowed Claims dated May 8, 2009.
U.S. Appl. No. 10/638,878, Final Office Action mailed Jan. 4, 2007.
U.S. Appl. No. 10/638,878, Office Action mailed Apr. 27, 2006.
U.S. Appl. No. 11/018,947, Non Final Office Action mailed Apr. 19, 2007.
U.S. Appl. No. 11/018,947, Non-Final Office Action, mailed Nov. 28, 2007.
U.S. Appl. No. 11/018,947, Notice of Allowance mailed Aug. 13, 2010.
U.S. Appl. No. 11/251,733, Non-Final Office Action mailed Aug. 31, 2009.
U.S. Appl. No. 11/251,733, Notice of Allowance mailed Jan. 11, 2010.
U.S. Appl. No. 12/056,916, Notice of Allowance mailed Apr. 26, 2010.
U.S. Appl. No. 12/270,129, Office Action mailed Sep. 2, 2009.
U.S. Appl. No. 12/270,129, Notice of Allowance mailed Sep. 29, 2010.
U.S. Appl. No. 12/573,960, Office Action mailed on Oct. 4, 2010.
U.S. Appl. No. 12/702,509, Final Office Action mailed Aug. 17, 2010.
U.S. Appl. No. 12/702,509, Office Action mailed Apr. 26, 2010.
International Application No. PCT/US2005/037507, PCT Search Report dated May 31, 2006.
International Application No. PCT/US08/058361, PCT Search Report dated Nov. 7, 2008.
International Application No. PCT/US08/058361, Written Opinion dated Nov. 7, 2008.
International Application No. PCT/US08/058361, International Preliminary Report on Patentabilty dated Oct. 8, 2009.
International Application No. PCT/US2010/038471, International Search Report and Written Opinion mailed Sep. 6, 2010.
Response to Mar. 27, 2012 First Office Action, Chinese Patent Application No. 200880010206.5, Aug. 10, 2012, 20 pages [translation of claims only].
Action Closing Prosecution, U.S. Reexamination Control No. 95/001,726, Aug. 28, 2012, 56 pages.
Notice of Preliminary Rejection, Korean Application No. 10-2007-7008403, Aug. 10, 2012, 4 pages.
Office Action, U.S. Appl. No. 13/595,487, Oct. 25, 2012, 9 pages.
Notice of Allowance, U.S. Appl. No. 12/270,129, Oct. 11, 2012, 17 pages.
Amendment Accompanying Request for Continued Examination, U.S. Appl. No. 12/270,129, Sep. 26, 2012, 13 pages.
Response to Jun. 25, 2012 Communication Pursuant to 94(3)EPC, EP Application No. 11172031.4, Oct. 24, 2012, 7 pages.
Response to Jun. 14, 2012 Communication Pursuant to 94(3)EPC, EP Application No. 11172028.0, Oct. 4, 2012, 72 pages.
Notification to Grant Patent Right of Invention, Chinese Patent Application No. 200910164633.5, Aug. 31, 2012, 5 pages.
Patent Owners Amendment and Comments in Response to Action Closing Prosecution in Inter Partes Reexamination, U.S. Reexamination Control No. 95/001,726, Sep. 28, 2012, 14 pages.
Comments of Requester Tandus Flooring, Inc., U.S. Reexamination Control No. 95/001,726, Oct. 26, 2012, 9 pages.
Office Action, U.S. Appl. No. 12/573,960, Oct. 16, 2012, 9 pages.
Amendment and Response to Aug. 10, 2012 Office Action, Korean Application No. 10-2007-7008403, Oct. 10, 2012, 9 pages [no translation available].
Second Office Action, Chinese Patent Application No. 200880010206.5, Oct. 12, 2012, 7 pages [partial translation only].
Action Closing Prosecution, U.S. Reexamination Control No. 95/001,725, Aug. 28, 2012, 57 pages.
Patent Owners Amendment and Comments in Response to Action Closing Prosecution in Inter Partes Reexamination, U.S. Reexamination Control No. 95/001,725, Sep. 28, 2012, 14 pages.
Comments of Requester Tandus Flooring, Inc., U.S. Reexamination Control No. 95/001,725, Oct. 26, 2012, 9 pages.
Right of Appeal Notice, U.S. Reexamination Control No. 95/001,726, Dec. 12, 2012, 51 pages.
First Office Action, Japanese Patent Application No. 2010-501209, Dec. 19, 2012, 6 pages.
Notice of Appeal by Patent Owner, U.S. Reexamination Control No. 95/001,726, Jan. 14, 2013, 5 pages.
Right of Appeal Notice, U.S. Reexamination Control No. 95/001,725, Jan. 23, 2013, 90 pages.
Office Action, U.S. Appl. No. 12/754,994, Nov. 26, 2012, 85 pages.
Response to Non-Final Office Action, U.S. Appl. No. 12/573,960, Jan. 16, 2013, 7 pages.
Amendment and Response to Office Action, U.S. Appl. No. 13/595,487, Jan. 3, 2013, 11 pages.
Summons to Attend Oral Hearing Pursuant to Rule 115(1) EPC, EP Application No. 10180493.8, Dec. 3, 2012, 8 pages.
Response to Nov. 15, 2011 Communication Pursuant to Rule 115(1) EPC and Rule 116EPC, EP Application No. 058127374, 88 pages.
Final Office Action, U.S. Appl. No. 13/595,487, Feb. 4, 2013, 11 pages.
First Office Action, Japanese Patent Application No. 2011-6501, Dec. 19, 2012, 6 pages.
Second Office Action, Chinese Patent Application No. 200880010206.5, Oct. 12, 2012, 9 pages.
Decision on Petitions, U.S. Reexamination Control No. 95/001,725, Aug. 10, 2012, 6 pages.
Decision on Petitions, U.S. Reexamination Control No. 95/001,726, Aug. 9, 2012, 6 pages.
Summons to Attend Oral Hearing Pursuant to Rule 115(1) EPC, EP Application No. 10180426.8, Oct. 10, 2012, 8 pages.
Notice of Allowance, U.S. Appl. No. 12/573,960, Feb. 28, 2013, 10 pages.
Decision to Refuse a European Patent Application, EP Application No. 058127374, Feb. 20, 2013, 37 pages.

Provision of a Copy of the Minutes in Accordance with Rule 124(4)EPC, EP Application No. 058127374, Feb. 18, 2013, 20 pages.
Appeal Brief of Patent Owner in Inter Partes Reexamination with Exhibits A-K, Related Proceedings Appendix, Claims Appendix and Evidence Appendix, U.S. Reexamination Control No. 95/001,726, Mar. 14, 2013, 303 pages.
Petition Under 37 C.F.R. § 1.183 to Exceed the p. Limit for Patent Owner's Appeal Brief in an Inter Partes Reexamination, U.S. Reexamination Control No. 95/001,726, Mar. 14, 2013, 4 pages.
Notice of Appeal by Patent Owner, U.S. Reexamination Control No. 95/001,725, Feb. 25, 2013, 5 pages.
Notice of Allowance, U.S. Appl. No. 13/595,487, Mar. 1, 2013, 10 pages.
Response to Final Office Action, U.S. Appl. No. 13/595,487, Feb. 7, 2013, 2 pages.

* cited by examiner

CARPET TILES AND CARPET TILE INSTALLATIONS

RELATED APPLICATION DATA

The present application claims priority to U.S. Provisional Application No. 61/268,433, filed Jun. 12, 2009, entitled "CARPET TILES AND CARPET TILE INSTALLATIONS," the contents of which are herein incorporated by reference. The present application is a continuation-in-part of U.S. Ser. No. 12/270,129, filed Nov. 13, 2008, entitled "SYSTEM AND METHOD FOR FLOOR COVERING INSTALLATION," which is a continuation of Ser. No. 11/018,947, filed Dec. 21, 2004, now U.S. Pat. No. 7,464,510, entitled "SYSTEM AND METHOD FOR FLOOR COVERING INSTALLATION," which claims priority to U.S. Provisional Application No. 60/619,340, filed Oct. 15, 2004, and is a continuation-in-part of U.S. Ser. Nos. 10/381,025 filed Dec. 8, 2003 and 10/638,878 filed Aug. 11, 2003, the contents of all of which are hereby incorporated by reference.

FIELD OF THE INVENTION

Embodiments of this invention generally relate to carpet tiles and other textile face modular flooring and to methods of designing modular flooring tiles having patterns and configurations that provide various aesthetic and functional benefits.

BACKGROUND

Conventional carpet tile has historically been a product that sought to mimic the appearance of broadloom carpet, which is continuous, and to hide or at least de-emphasize the fact that the product was modular. The imperative of a broadloom-like, continuous appearance long dictated that carpet tile styles be uniform in color and pattern within tiles and from one tile to another. For these reasons, carpet tiles in a carpet tile installation were conventionally of the same size and shape from one tile to another.

However, textile face modular flooring designers have recently begun to design flooring and flooring installations that do not seek to mask, but rather emphasize, the modularity of the flooring. Such carpet tiles are often installed "quarter-turned" with each tile position rotated 90° relative to each adjacent tile.

Traditionally, modules were often glued to the floor by first applying a layer of adhesive to the underlying flooring surface and then positioning the tiles on top of the adhesive. With this method, adhesive typically contacts the entire surface area of the underside of the flooring modules, which increases material costs and often leads to difficultly in re-positioning the tiles if they are positioned incorrectly. This is a particular problem during installation of patterned modules that must be matched at the seams. Moreover, when the modules are eventually removed, glue remains on the flooring surface and that glue sometimes retains portions of the removed tiles. The glue (and any flooring materials held by the glue) must be removed from the floor to create a smooth surface before installing new tiles. This adds both cost and time to the installation process.

As described in U.S. Pat. No. 7,464,510 (entitled "System and Method for Floor Covering Installation," filed Dec. 21, 2004), which is incorporated herein in its entirety by this reference, connectors for joining adjacent modular floor covering units recently have been developed. Such connectors allow for the assembly of carpet tiles on an underlying floor surface without the need to attach them to the floor surface.

SUMMARY

Embodiments of the invention provide carpet tiles of varying size and/or shape within a carpet tile installation and, in some instances, use carpet tiles of different color, pattern or style. In some embodiments, carpet tiles cut from a carpet web in a standard size and shape, such as one-half square meter carpet tiles, are partitioned into smaller carpet tile fractions. In certain embodiments, these carpet tile fractions are used in conjunction with larger carpet tiles in a carpet tile installation. In other embodiments, these carpet tile fractions are connected to other carpet tile fractions to form a combination carpet tile that is then used in a carpet tile installation. In some embodiments, this combination carpet tile is used with other carpet tiles in the carpet tile installation. In yet other embodiments, carpet tile fractions are cut directly from a carpet web and are used with other carpet tiles or with carpet tiles of a different size and/or shape, also cut from a carpet web, in a carpet tile installation.

BRIEF DESCRIPTION OF THE DRAWINGS

A full and enabling disclosure including the best mode of practicing the appended claims and directed to one of ordinary skill in the art is set forth more particularly in the remainder of the specification. The specification makes reference to the following appended figures, in which use of like reference numerals in different figures is intended to illustrate like or analogous components.

DETAILED DESCRIPTION

Certain embodiments of the invention utilize carpet tiles of varying size and/or shape within a carpet tile installation and, in some instances, use carpet tiles of different color, pattern or style. In some embodiments, carpet tiles of a standard size and shape, such as one-half square meter carpet tiles, are cut from a carpet web and partitioned into carpet tile fractions. In certain embodiments, these carpet tile fractions are used in conjunction with larger carpet tiles in a carpet tile installation. In other embodiments, these carpet tile fractions are connected to other carpet tile fractions to form a combination carpet tile that is then used in a carpet tile installation. In some embodiments, this combination carpet tile is used with other carpet tiles, or with carpet tiles of a different size and/or shape, in the carpet tile installation.

Among other things, the use of different sized carpet tiles increases the randomness or diversity and/or improves other aspects of the appearance of the carpet tile installations.

Carpet tiles of different sizes and/or shapes can be formed in a variety of ways. Commercial carpet tiles may be manufactured utilizing a number of techniques, but the substantial majority of such products are manufactured by tufting carpet yarns into a tufting primary using a tufting machine. The fabric produced by the tufting machine is usually about six feet or two meters wide, and that fabric is referred to here as a carpet tile "web." After the web is produced, one or more secondary backing layers are bonded to its underside to provide stability, stiffness, weight and other desirable properties, and the backed web is then cut into tiles.

Tiles can be cut from the web to create carpet tiles of different sizes and/or shapes. Alternatively, tiles of a single size (such as standard one-half square meter carpet tiles) may be initially cut from the web and then some or all of those tiles may be subsequently cut to form smaller tiles, referred to here as carpet tile fractions, of one or more varying shapes and other dimensions.

As shown in the Figures, the carpet tile installations of certain embodiments of this invention utilize square carpet tiles of a standard size manufactured in conventional manufacturing processes. In some embodiments, these square tiles are then cut into smaller carpet tile fractions, including, among other possibilities, smaller rectangular, triangular and/or square tile pieces. This second cutting operation can occur immediately after manufacture at the manufacturing facility, or can occur in the field during the installation process.

Figure 1:
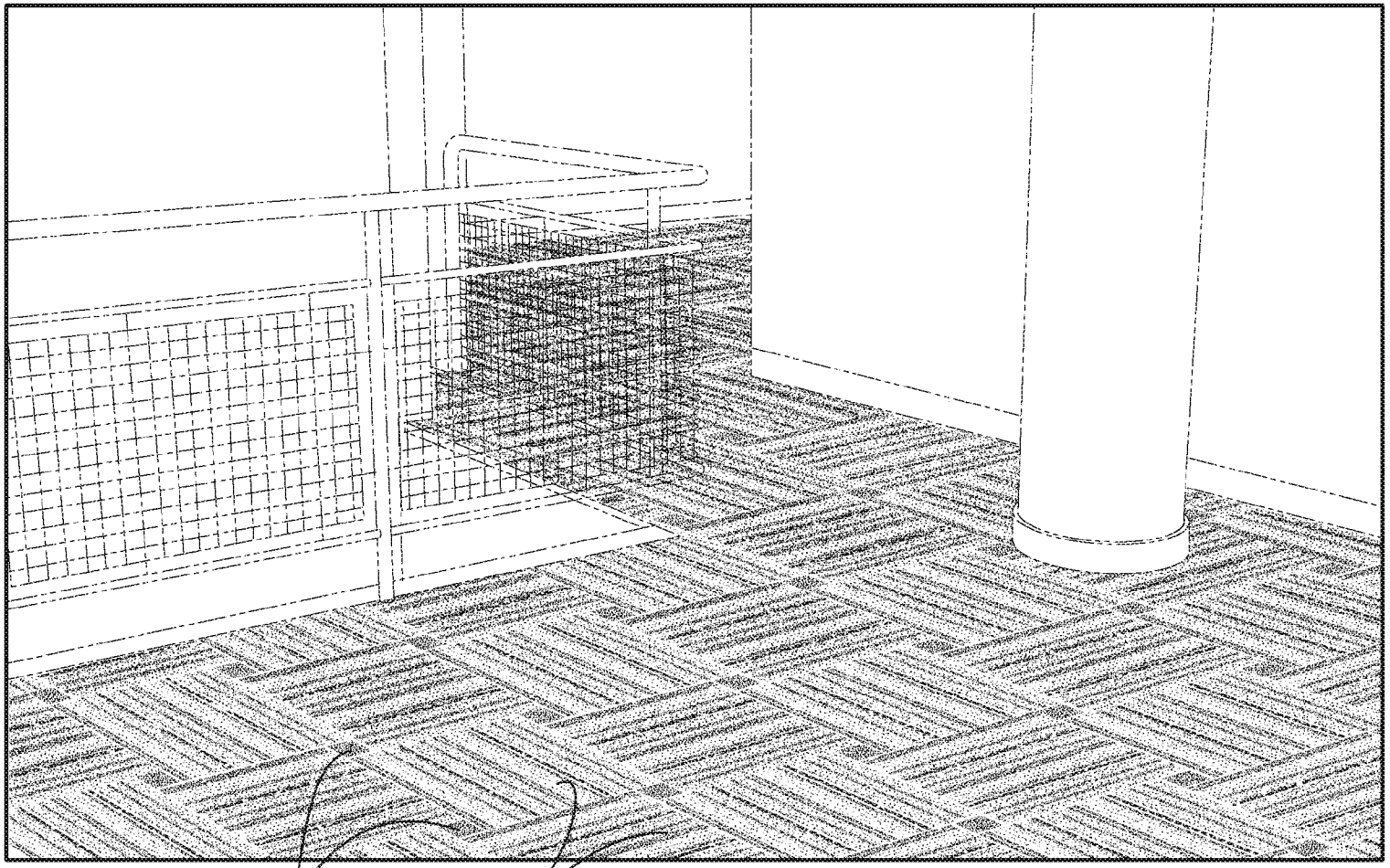
FIG. 1 is a perspective view of a carpet tile installation using larger square carpet tiles and smaller square carpet tiles according to one aspect of the invention.
Figure 2:
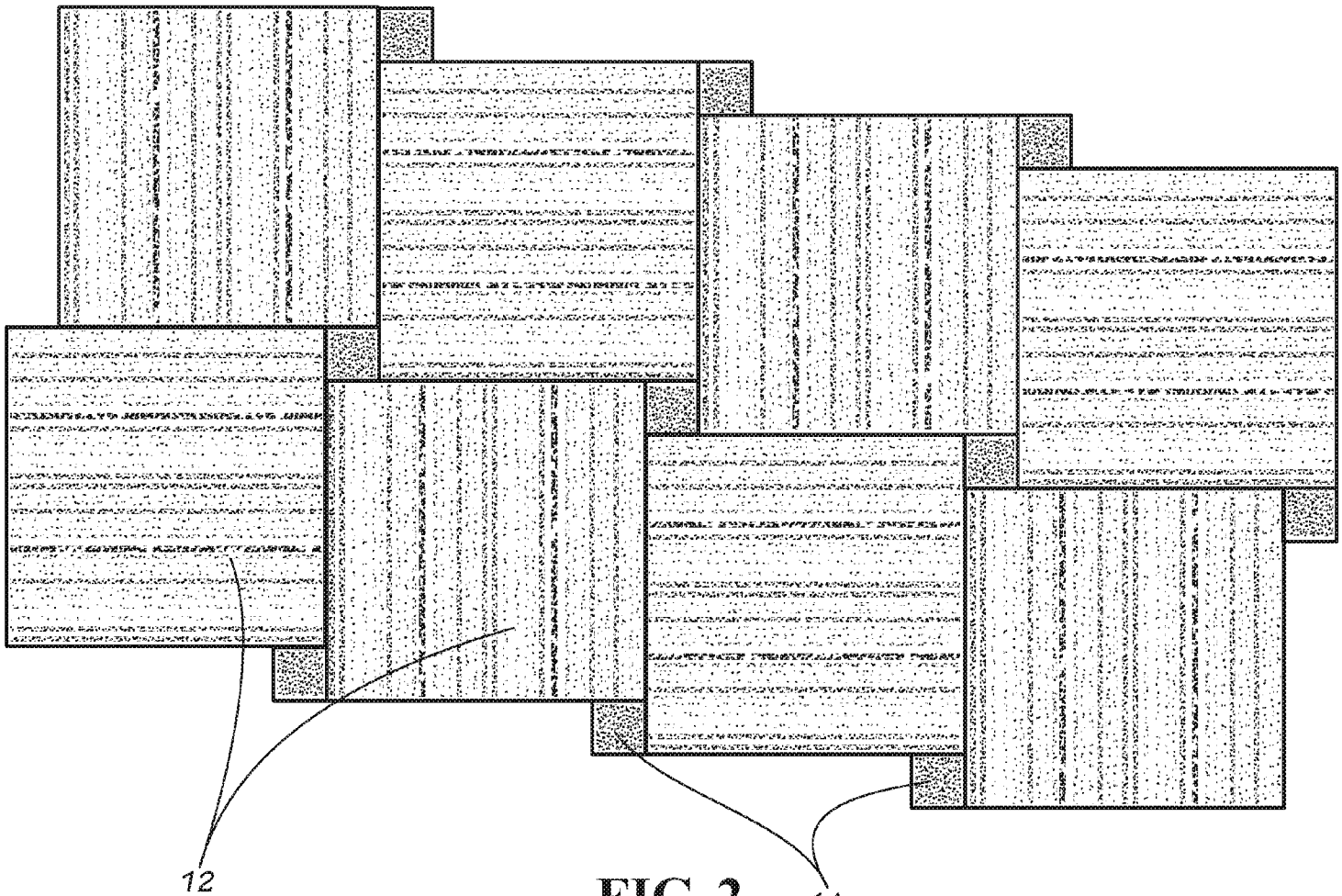
FIG. 2 is a top plan view of the installation pattern used in FIG. 1.
Figure 3A:
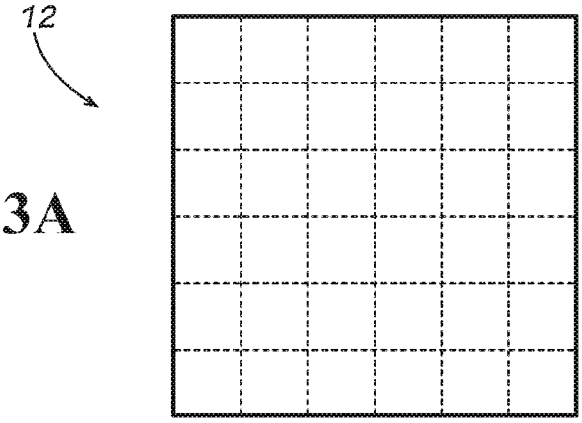
FIG. 3A is a top plan view of an exemplary method of partitioning a larger square carpet tile into the smaller square carpet tiles used in the installation shown in FIG. 1.
Figure 3B:
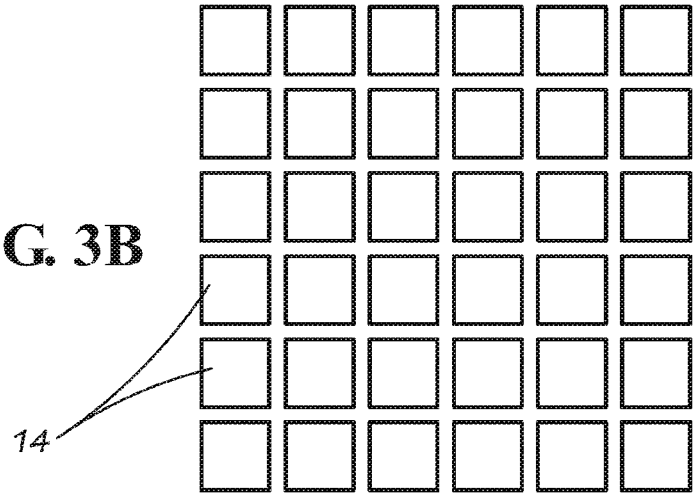
FIG. 3B is a top plan view of the smaller square carpet tiles cut from the larger square carpet tile of FIG. 3A and used in the installation shown in FIG. 1.

FIGS. 1-2 illustrates a carpet tile installation 10 comprised of larger square carpet tiles 12 and carpet tile fractions 14 that together form an exemplary installation pattern. In this embodiment, carpet tile fractions 14 are square carpet tiles that are smaller than larger square carpet tiles 12. While this particular installation pattern provides various aesthetic and other benefits, other installation patterns may be used. As shown in FIG. 3A, a larger square tile 12, such as a standard one-half square meter carpet tile, may be partitioned into carpet tile fractions and subsequently cut into carpet tile fractions 14, as shown in FIG. 3B. In other embodiments, carpet tile fractions 14 are cut directly from the carpet web without first being cut into the standard, larger square carpet tile 12.

The larger square carpet tiles 12 and carpet tile fractions 14 may be secured to the floor and/or one another using adhesive, tape, and/or various connectors, including, but not limited to, connectors such as those disclosed in U.S. Pat. No. 7,464,510 (entitled "System and Methods for Floor Covering Installation, filed Dec. 21, 2004), the entirety of which is incorporated herein by this reference.

Figure 4:
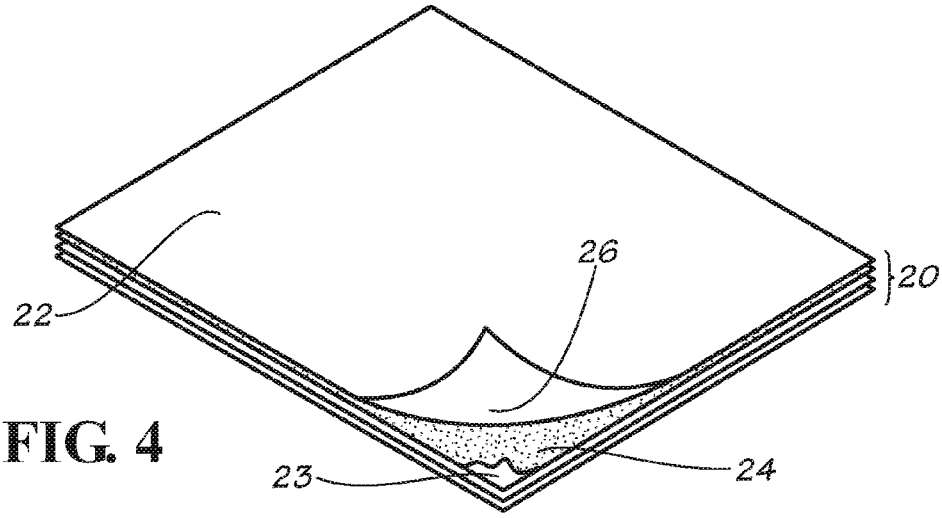
FIG. 4 is perspective view of one embodiment of a connector and release layer according to one aspect of this invention.

In one embodiment, the carpet tile installation 10 illustrated in FIG. 1 comprises larger square carpet tiles 12 and carpet tile fractions 14 that are connected to one another using one or more connectors 20. As shown in FIG. 4, connector 20 includes a film 22 and an adhesive layer 24 coated on one side of the film 22. An optional release layer 26 is placed on top of the adhesive layer 24 to protect the underlying adhesive. In use, the release layer 26 is removed from the connector 20 to expose the adhesive layer 24.

The film 22 may be of any suitable material, but, to facilitate rapid flooring installations in accordance with this invention, is preferably made of a material that is relatively stiff so that a connector 20 positioned partly in contact with the underside of a tile will project beyond the edge of the tile in roughly the same plane as the underside of the tile. This facilitates proper positioning of the projecting connector portion to make appropriate contact with an adjacent tile. This is typically greater stiffness than most adhesive tapes that will significantly curl or droop down from an underside of a tile to which a portion (but not all) of a length of such adhesive tape is attached. At the same time, the film 22 from which connectors of this invention are made should be sufficiently flexible to facilitate handling the connectors in a roll if desired and to permit the connectors to conform to floor or tile irregularities.

The film 22 should also resist shrinkage, which can result in buckling of adjacent tiles, and exhibit a relatively high tensile strength to resist stretching under foot traffic and rolling loads. For example, materials that exhibit a tensile strength between 160-270 mega Pascals ("MPa") in the machine direction and 165-210 MPa in the cross-machine direction have been found particularly suitable for this application. Moreover, the percentage by which the material may be elongated or stretched before breaking should also be relatively high to prevent connector breakage and failure when subjected to tensile stresses. For example, it is preferable, but not required, that the material used be capable of being stretched 120-200% of its machine direction dimension and 150-170% of its cross-machine direction dimension before breaking.

The connector 20 is then positioned so that the adhesive layer 24 contacts the underside of adjacent tiles (such as larger square carpet tile 12 and carpet tile fraction 14) to span the adjacent edges of the tiles and thereby connect the tiles together to form a carpet tile installation. In this way, the tiles are assembled on a underlying flooring surface without the need to attach them to the floor surface, so that the tiles create a floor covering that "floats" on the underlying floor surface. Such a connector 20, for example, may be sized for use under some or all of the entirety of a carpet tile fraction (such as carpet tile fraction 14) and extending under one or more of the adjacent larger carpet tiles (such as larger square carpet tiles 12).

Figure 5B:
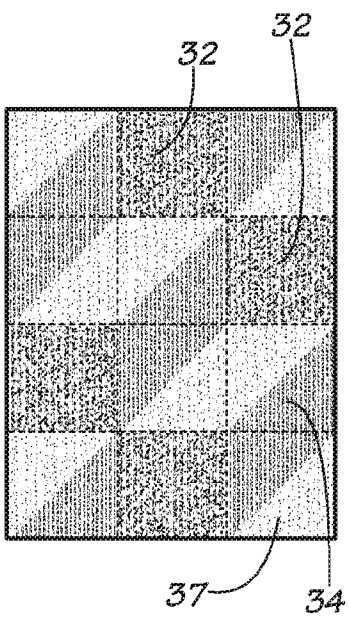
FIG. 5B is a partial top plan view of the repeating pattern used to form the carpet tile installation illustrated in FIG. 5A.
Figure 5A:
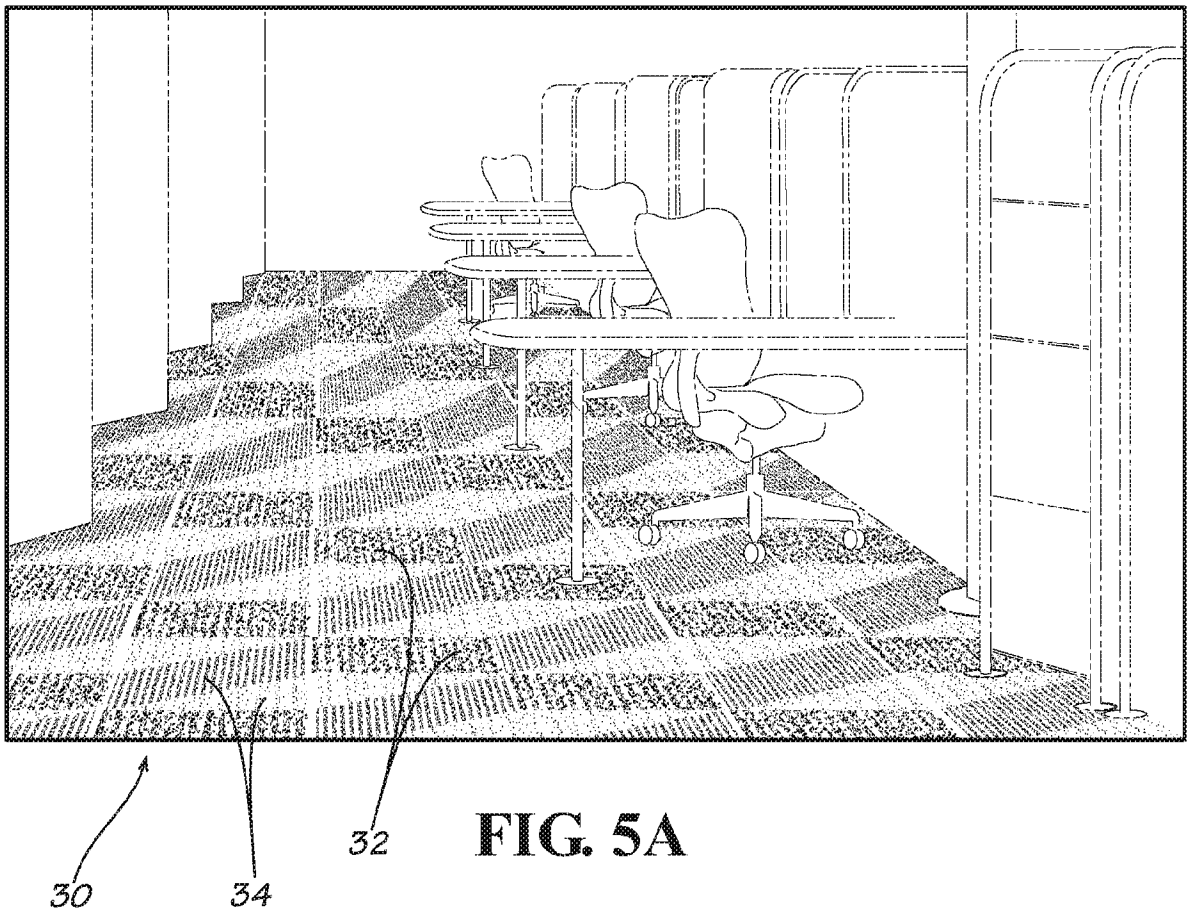
FIG. 5A is a perspective view of a carpet tile installation using larger square carpet tiles and smaller carpet tile fractions according to one aspect of the invention.
Figure 6B:
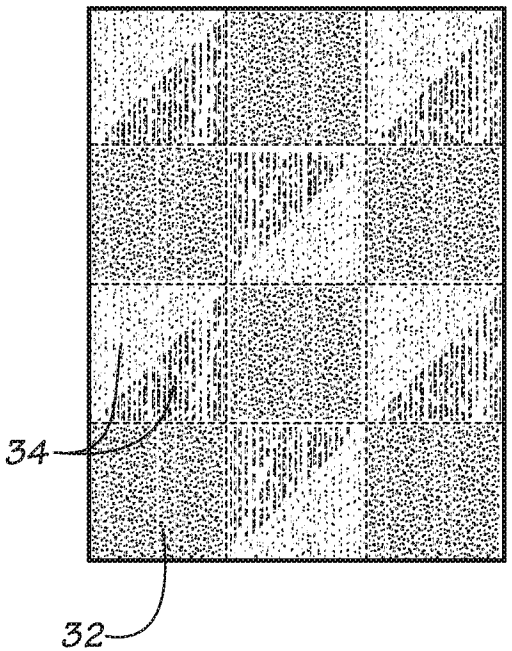
FIG. 6B is a partial top plan view of the repeating pattern used to form the carpet tile installation illustrated in FIG. 6A.
Figure 6A:
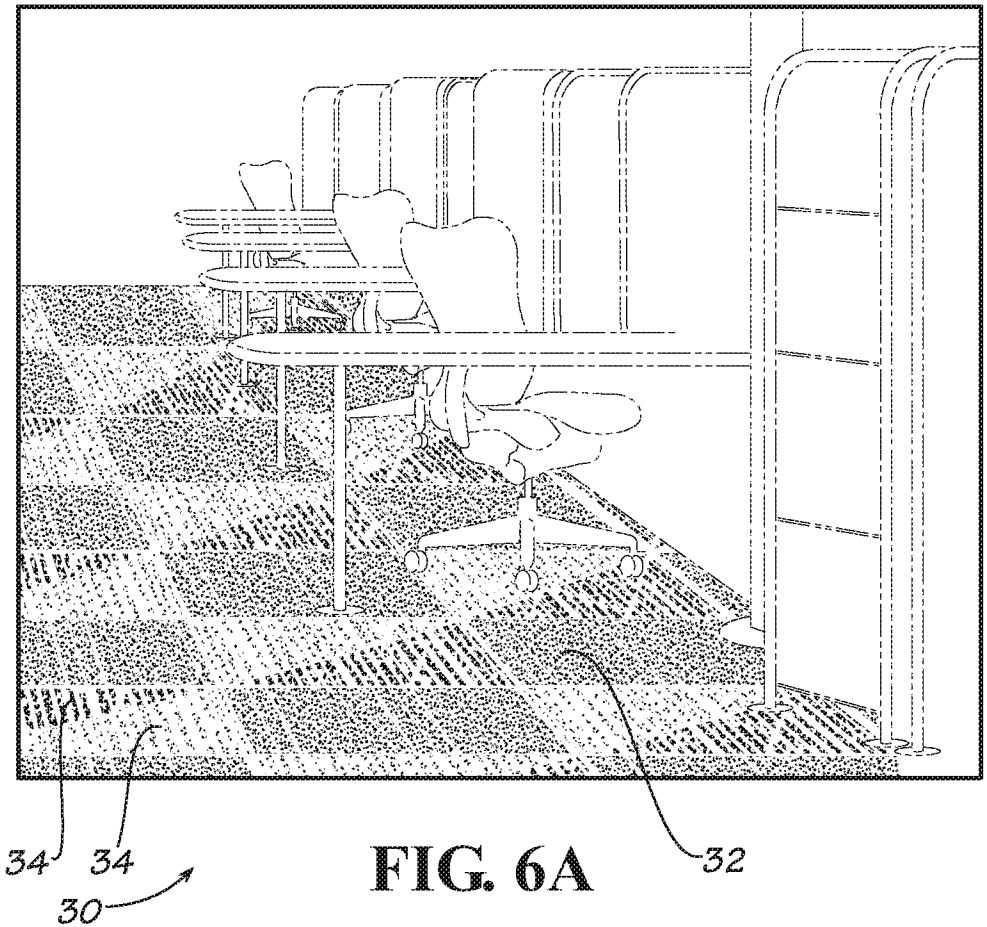
FIG. 6A is a perspective view of a carpet tile installation using larger square carpet tiles and smaller carpet tile fractions according to another aspect of the invention.

FIGS. 5A and 6A illustrate a carpet tile installation 30 according other embodiments of the invention. Carpet tile installation 30 is comprised of larger square carpet tiles 32 and carpet tile fractions 34 that together form an exemplary installation pattern (shown in FIG. 5B). In the embodiments shown in FIGS. 5A and 6A, carpet tile fractions 34 are carpet tiles of a triangular shape. The patterns shown in FIGS. 5B and 6B may be repeated to form the carpet tile installation 30.

While these particular installation patterns provide various aesthetic and other benefits, other installation patterns may be used.

Figure 7B:
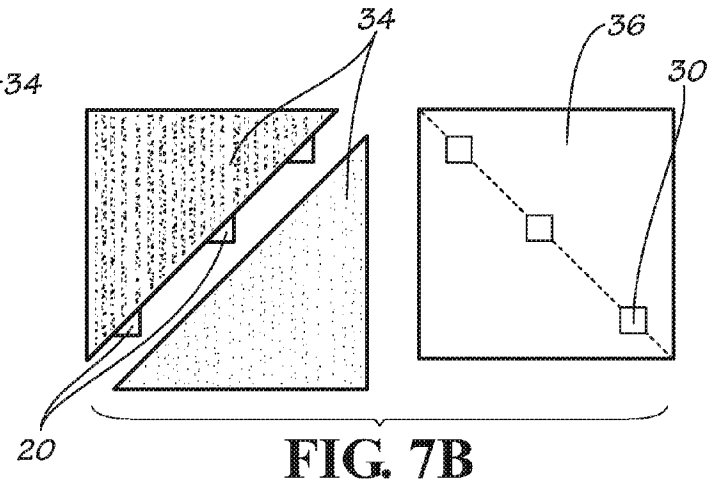
FIGS. 7A-7B are top plan views illustrating a technique for cutting carpet tile fractions from carpet tiles and for connecting the carpet tile fractions to form a combination carpet tile used in the repeating pattern of FIG. 6B.
Figure 7A:
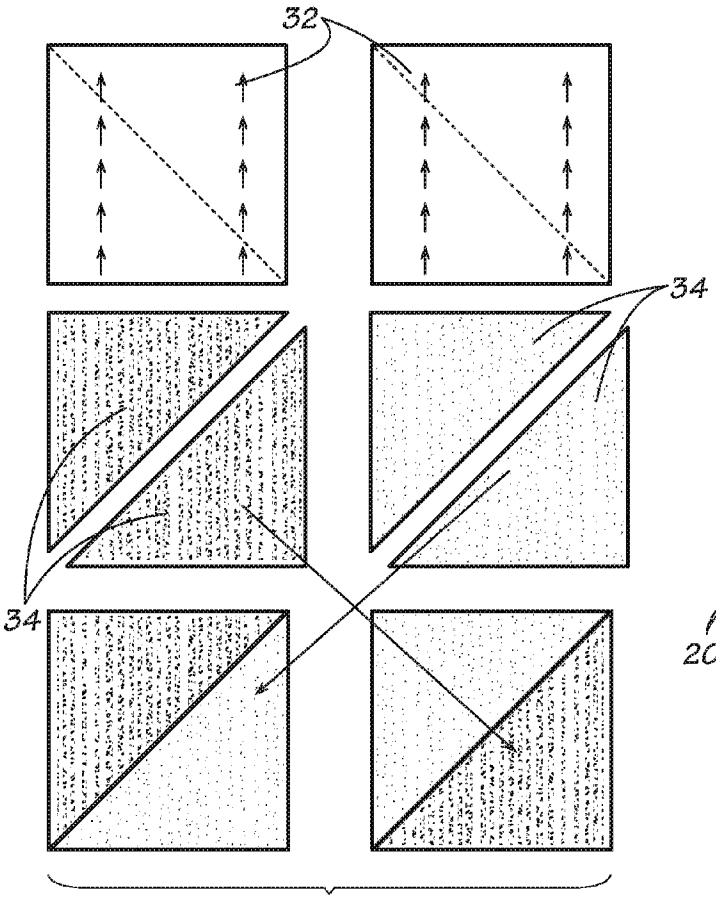

As shown in FIG. 7A, a larger square tile 32, such as a standard one-half square meter carpet tile, may be cut into carpet tile fractions 34, as shown in FIG. 7A. In other embodiments, carpet tile fractions 34 are cut directly from the carpet web without first being cut into the standard, larger square carpet tile 32. As shown in FIG. 7B, carpet tile fractions 34 then may be connected to one another using connectors 20 to form a combination carpet tile 36. These combination carpet tiles 36 may then be connected using connectors 20 to each other and/or to larger square, non-combination carpet tiles 32 in any number of patterns, such as the patterns of the carpet tile installations 30 shown in FIG. 5A or FIG. 6A.

Figure 8A:
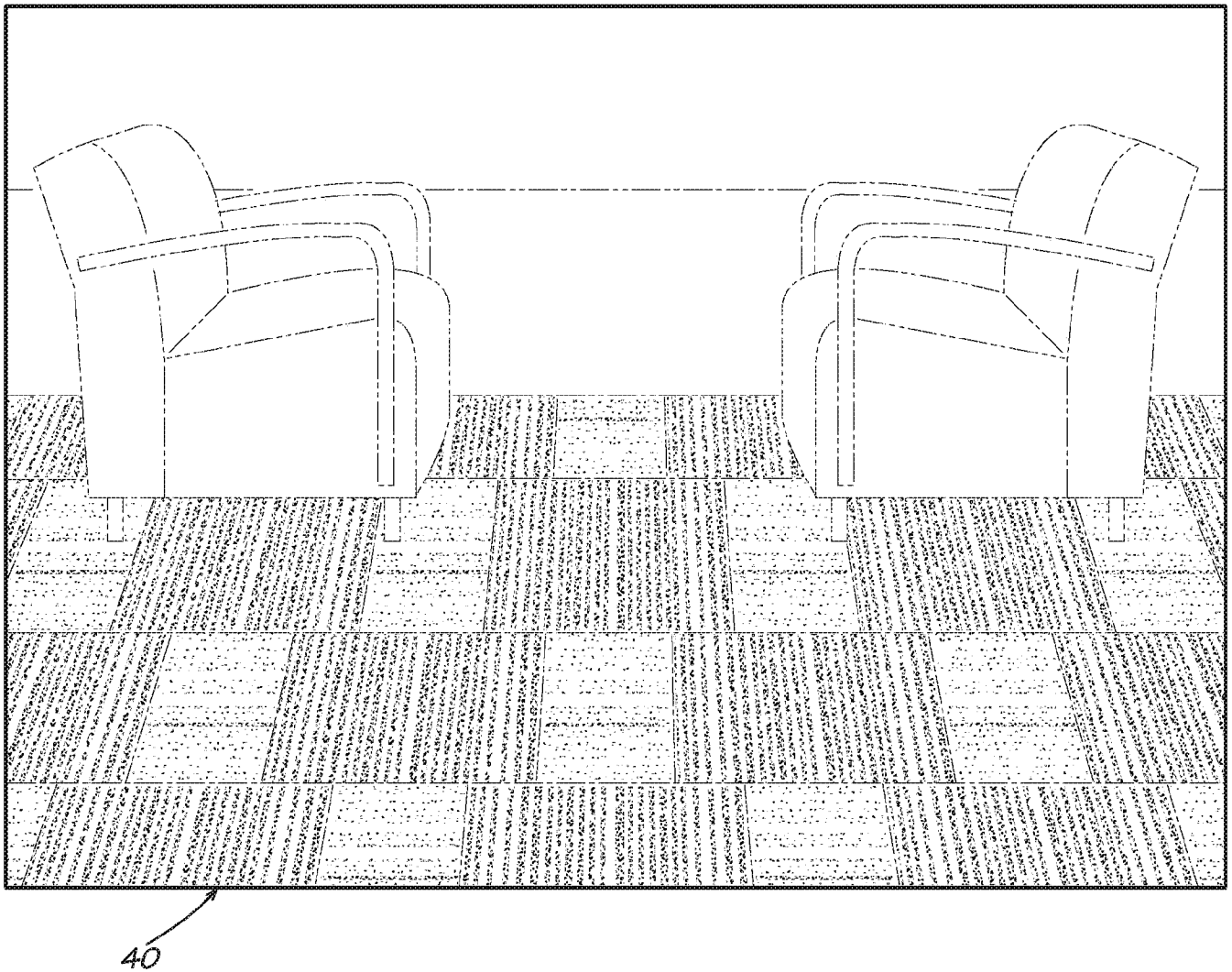
FIG. 8A is a perspective view of a carpet tile installation using larger square carpet tiles and smaller carpet tile fractions according to yet another aspect of the invention.

FIG. 8A illustrates a carpet tile installation 40 according to another embodiment of the invention. Carpet tile installation 40 is comprised of larger square carpet tiles 42 and carpet tile fractions 44 that together form an exemplary installation pattern. The pattern shown in FIG. 8B may be repeated to form the carpet tile installation 40 shown in FIG. 8A. While this particular installation pattern provides various aesthetic and other benefits, other installation patterns may be used.

Figure 8C:
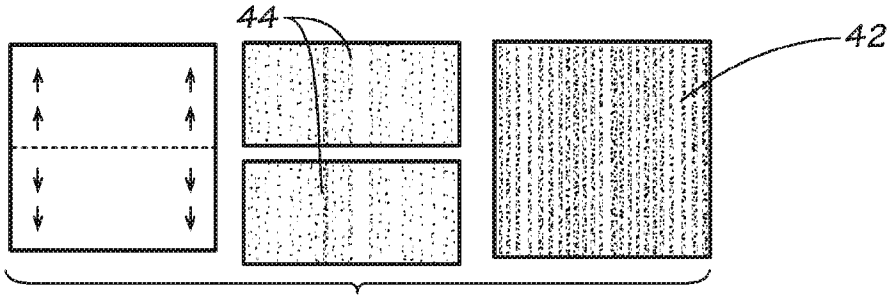
FIG. 8C is a top plan view illustrating a technique for cutting carpet tile fractions from carpet tiles for use in the repeating pattern of FIG. 8B.
Figure 8B:
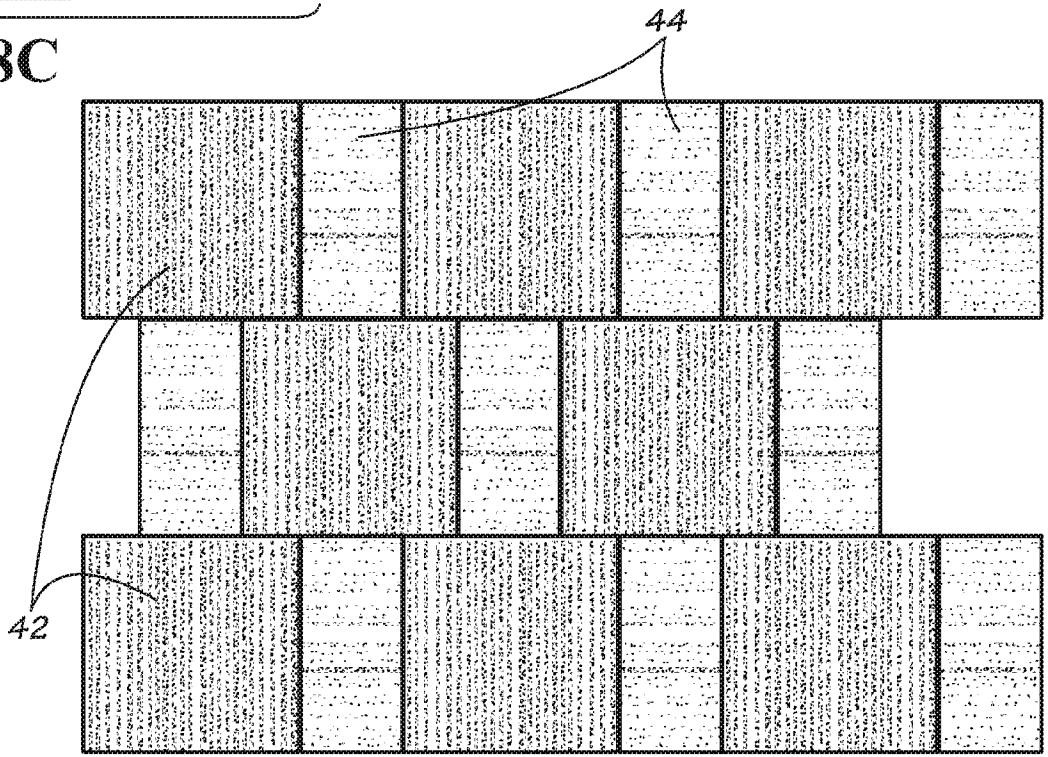
FIG. 8B is a partial top plan view of the repeating pattern used to form the carpet tile installation illustrated in FIG. 8A.

As shown in FIG. 8C, a larger square tile, such as a standard one-half square meter carpet tile, may be cut into carpet tile fractions 44, as shown in FIG. 8C. In other embodiments, carpet tile fractions 44 are cut directly from the carpet web without first being cut into the standard, larger square carpet tile. Carpet tile fractions 44 may then be arranged in any number of patterns with larger square tiles 42 to form a carpet tile installation. In some embodiments, larger square carpet tiles 42 and carpet tile fractions 44 are connected using connectors 20.

Figure 9A:
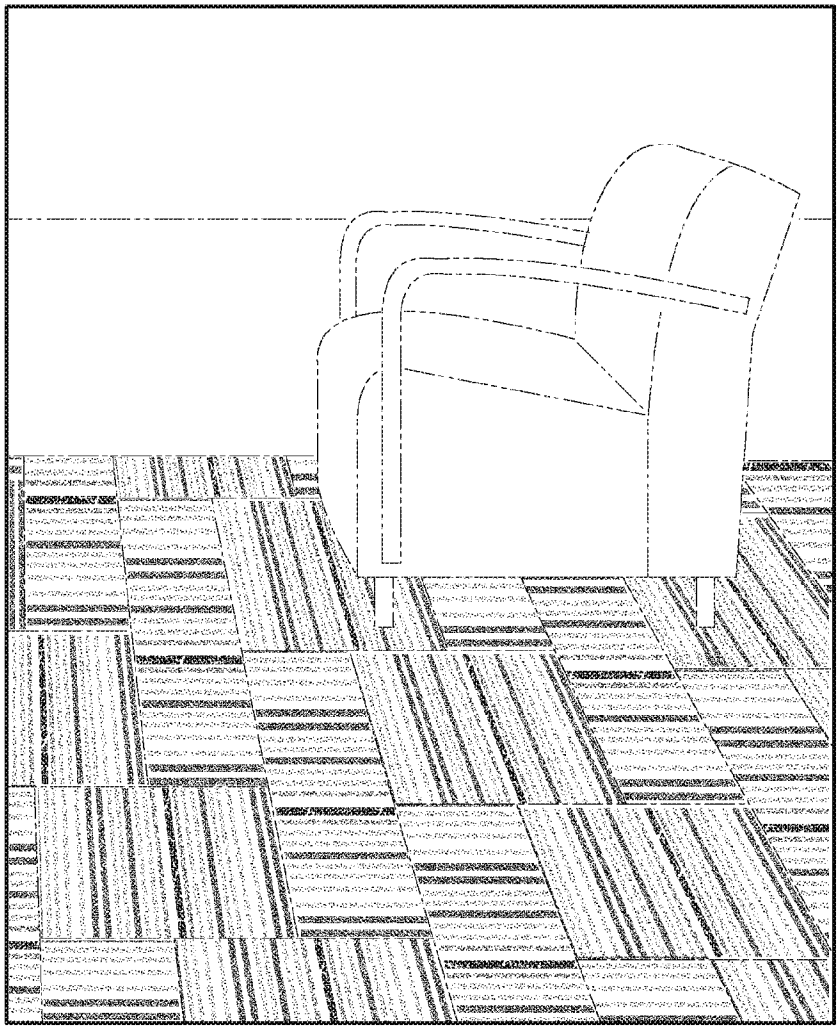
FIG. 9A is a perspective view of a carpet tile installation using larger square carpet tiles and smaller carpet tile fractions according to still another aspect of the invention.

FIG. 9A illustrates a carpet tile installation 50 according to another embodiment of the invention. Carpet tile installation 50 is comprised of carpet tile fractions 54 that together form an exemplary installation pattern. The pattern shown in FIG. 9B may be repeated to form the carpet tile installation 50 shown in FIG. 9A. While this particular installation pattern provides various aesthetic and other benefits, other installation patterns may be used.

Figures 9B, 9C:
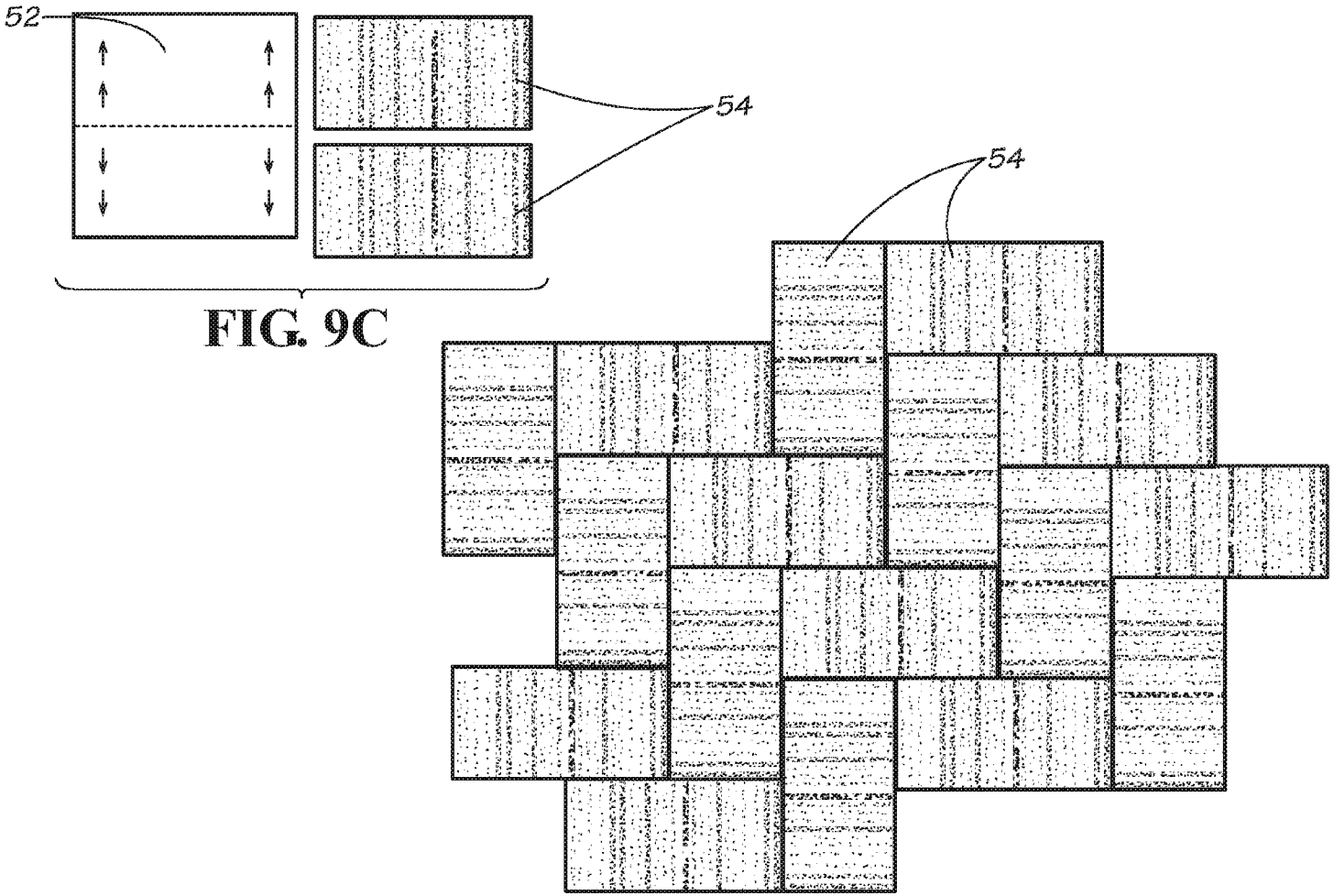
FIG. 9B is a partial top plan view of the repeating pattern used to form the carpet tile installation illustrated in FIG. 9A.
FIG. 9C is a top plan view illustrating a technique for cutting carpet tile fractions from carpet tiles for use in the repeating pattern of FIG. 9B.

As shown in FIG. 9C, a larger square tile 52, such as a standard one-half square meter carpet tile, may be cut into carpet tile fractions 54. In other embodiments, carpet tile fractions 54 are cut directly from the carpet web without first being cut into the standard, larger square carpet tile 52. Carpet tile fractions 44 may then be arranged in any number of patterns to form a carpet tile installation. In some embodiments, the carpet tile fractions 44 are connected to one another using connectors 20.

Although the carpet tile fractions of this invention may be made from conventionally manufactured square tiles in any size and shape smaller than the starting square tiles, cutting schemes and installation patterns that utilize all parts of the originally square tile are the most economical in terms of tile cost, since they require the least number of square tiles. This invention includes, but is not limited to, embodiments that utilize the entire square tiles.

The carpet tile installations of FIGS. 1, 5A, 6A, 8A, and 9A may be made from carpet tiles having virtually any combination of tile colors and patterns. Particularly pleasing designs often use one color or style for all of the large tiles and a different color or style for all of the small tiles, and the pattern is visually most striking if there is significant contrast between the appearance of the small tiles as compared to the appearance of the large tiles. Particularly attractive version of this invention utilize relatively light colored large tiles and relatively dark small tiles.

Also disclosed is a method of installing different sized and/or shaped carpet tiles using one or more connectors 20. In one method of installing the different sized and/or shaped carpet tiles using the connectors 20, a first tile is placed on the floor at a position determined by conventional tile installation methods. A connector 20 is peeled from the release layer 26 (or from a stack of connectors 20) and positioned so that the adhesive layer 24 faces upward away from the underlying floor. The connector 20 is positioned so that only a portion of the adhesive layer 24 adheres to the underside of the tile, leaving the remainder of the connector 20 extending from the underside of the tile. A different sized and/or shaped tile or tiles are then positioned adjacent the first tile so that a portion of the connector 20 adheres to the adjacent tile(s). In this way, the connector spans the adjacent edge(s) of the adjacent tile(s).

These disclosed embodiments are merely illustrative. In short, the techniques and the other features described herein have uses in a variety of contexts, not to be limited by the specific illustrations provided herein. Embodiments may comprise different carpet tile shapes, colors, sizes, patterns, and other methods of producing and installing the carpet tiles and carpet tile installations than those disclosed herein may be utilized. The features shown are merely illustrative and are not intended to indicate that any component, feature, or method step is essential or necessary to any embodiment or limiting the scope of the present disclosure. The foregoing description of the embodiments has been presented only for the purpose of illustration and description and is not intended to be exhaustive or to limit the disclosure to the precise forms disclosed. Numerous modifications and adaptations are apparent to those skilled in the art without departing from the spirit and scope of the disclosure.

The invention claimed is:

1. A floor covering comprising a plurality of carpet tiles cut from a carpet web, wherein each of the plurality of carpet tiles comprises a textile face size and an underside, wherein a first textile face size of a first set of the plurality of carpet tiles is smaller than a second textile face size of a second set of the plurality of carpet tiles, wherein at least one of the carpet tiles of the first set is connected to at least one of the carpet tiles of the second set along adjacent edges of the tiles without attaching either of the carpet tiles to a floor surface on which the carpet tiles are positioned, each connector comprising:

a. a film configured to resist stretching; and b. a layer of adhesive located on a side of the film, wherein the layer of adhesive is capable of forming a bond with the undersides of the carpet tiles so that, when the connector is positioned above the floor surface and spans the adjacent edges of the at least one of the carpet tiles of the first set and the at least one of the carpet tiles of the second set so that the layer of adhesive contacts the undersides of the tiles, the layer of adhesive prevents relative movement between the tiles, and the connector does not adhere to the floor surface.

2. The floor covering of claim 1, wherein the carpet tiles of the first set of the plurality of carpet tiles have a first shape that is different from a second shape of the carpet tiles of the second set of the plurality of carpet tiles.

3. The floor covering of claim 1, wherein the carpet tiles of the first set of the plurality of carpet tiles have a first shape that is substantially the same as a second shape of the carpet tiles of the second set of the plurality of carpet tiles.

4. The floor covering of claim 1, wherein the carpet tiles of the first set of the plurality of carpet tiles have a first pattern that is different from a second pattern of the carpet tiles of the second set of the plurality of carpet tiles.

5. The floor covering of claim 1, wherein the carpet tiles of the first set of the plurality of carpet tiles are cut from a larger carpet tile.

6. The floor covering of claim 1, wherein the carpet tiles of the first set of the plurality of the carpet tiles are cut directly from the carpet web.

7. The floor covering of claim 1, wherein the second textile face size of the carpet tiles of the second set are approximately one-half square meter.

8. The floor covering of claim 7, wherein the carpet tiles of the first set are cut from approximately one-half square meter carpet tiles.

9. The floor covering of claim 1, wherein at least one of the carpet tiles of the first set of the plurality of carpet tiles is connected to another one of the carpet tiles in the first set of the plurality of carpet tiles using at least one connector to form a combination carpet tile.

10. The floor covering of claim 9, wherein the at least one of the carpet tiles and the another one of the carpet tiles are triangular in shape.

11. The floor covering of claim 9, wherein the combination carpet tile comprises a substantially square shape.

12. The floor covering of claim 1, wherein the film of the connector is configured to resist stretching by comprising a material exhibiting a tensile strength between 160 and 270 MPa in at least one direction.

13. A method of installing different sized carpet tiles on a floor surface comprising:

providing a first set of carpet tiles of a first size, each of the carpet tiles of the first set comprising an underside;

providing a second set of carpet tiles of a second size, each of the carpet tiles of the second comprising an underside, wherein the first size is different from the second size;

providing a plurality of connectors, each comprising:

a film configured to resist stretching and a layer of adhesive located on a side of the film;

positioning at least one of the carpet tiles of the first set of carpet tiles and at least one of the carpet tiles of the second set of carpet tiles on the floor surface so that the tiles are adjacent to one another; and connecting the at least one of the carpet tiles of the first set to the at least one of the carpet tiles of the second set without attaching the tiles to the floor surface so that the connector spans adjacent edges of the tiles and so that the layer of adhesive contacts the undersides of the adjacent tiles and prevents relative movement between the adjacent tiles, wherein the connector does not adhere to the floor surface.

14. The method of claim 13, further comprising cutting both the first set of carpet tiles and the second set of carpet tiles directly from a carpet web.

15. The method of claim 13, wherein at least some of the carpet tiles in the first set of carpet tiles are cut from carpet tiles in the second set of carpet tiles.

16. The method of claim 13, wherein providing the second set of carpet tiles comprises providing approximately one-half square meter carpet tiles.

17. The method of claim 13, further comprising cutting the first set of carpet tiles from approximately one-half square meter carpet tiles.

18. The method of claim 13, further comprising connecting at least one of the carpet tiles in the first set to another one of the carpet tiles in the first set using at least one connector to form a combination carpet tile.

19. The method of claim 13, wherein the film of the connector is configured to resist stretching by comprising a material exhibiting a tensile strength between 160 and 270 MPa in at least one direction.

20. A method of cutting carpet tiles of different sizes comprising:

cutting a first set of carpet tiles of a first size from a carpet web, each of the carpet tiles of the first set comprising an underside;

cutting a second set of carpet tiles from at least some of the first set of carpet tiles, each of the carpet tiles of the second set comprising an underside;

providing a plurality of connectors, each comprising:

a film configured to resist stretching and a layer of adhesive located on a side of the film;

positioning at least one of the carpet tiles of the first set of carpet tiles and at least one of the carpet tiles of the second set of carpet tiles on the floor surface so that the tiles are adjacent to one another; and connecting the at least one of the carpet tiles in the first set to the at least one of the carpet tiles in the second set without attaching the tiles to the floor surface so that the connector spans adjacent edges of the tiles and so that the layer of adhesive contacts the undersides of the adjacent tiles and prevents relative movement between the adjacent tiles, wherein the connector does not adhere to the floor surface.

* * * * *